US006994348B2

(12) United States Patent
Lambert et al.

(10) Patent No.: US 6,994,348 B2
(45) **Date of Patent: *Feb. 7, 2006**

(54) DUELING TREE

(75) Inventors: Spencer Lambert, Provo, UT (US); Thomas Marshall, Lake Shore, UT (US); Kyle Burdette, Eagle Mountain, UT (US)

(73) Assignee: Action Target, Inc., Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/383,218

(22) Filed: Mar. 6, 2003

(65) Prior Publication Data

US 2004/0239035 A1 Dec. 2, 2004

Related U.S. Application Data

(60) Provisional application No. 60/362,744, filed on Mar. 8, 2002.

(51) Int. Cl.
*F41J 7/00* (2006.01)

(52) U.S. Cl. ..... 273/406; 273/392

(58) Field of Classification Search ..... 273/390–392, 273/406, 407, 386–389, 368; 84/486; 40/475, 40/500, 533

See application file for complete search history.

(56) References Cited

U.S. PATENT DOCUMENTS 1,207,456 A * 12/1916 Whelan ..... 40/533
1,543,605 A * 6/1925 Gavard ..... 40/475
2,008,359 A * 7/1935 Lamb ..... 273/402
2,179,471 A * 11/1939 Lee ..... 273/368
2,372,111 A * 3/1945 Clarance ..... 273/407
2,905,469 A * 9/1959 Taylor ..... 273/380
4,691,925 A * 9/1987 Scholem ..... 273/407
4,739,996 A * 4/1988 Vedder ..... 273/392
5,263,721 A * 11/1993 Lowrance ..... 273/390
5,352,170 A * 10/1994 Condo et al. ..... 482/83
6,398,215 B1 * 6/2002 Carroll ..... 273/108
6,478,301 B1 * 11/2002 Witmeyer ..... 273/391
6,502,820 B2 * 1/2003 Slifko ..... 273/391
6,776,418 B1 * 8/2004 Sovine et al. ..... 273/407

OTHER PUBLICATIONS

Mike Gibson Manufacturing Dynamic Steel Targets GSA Contract #GS-07F-0205N.
Metal Spinning Targets, Inc., Dueling Trees—Contents and Logos © 1997-2003 Metal Spinning Targets, Inc.
Law Enforcement Targets Inc., Steel Targets.
Outwest MFG. Products, Port-A-Fold™ Target Stand Base & Target Holder.

* cited by examiner

*Primary Examiner*—Mark S. Graham
(74) *Attorney, Agent, or Firm*—Bateman IP Law Group

(57) ABSTRACT

A target system includes a plurality of targets mounted on a center support so that the targets rotate between opposing sides of the center support. Preferably, the targets rotate about an axis which is between 5 and 30 degrees less than vertical, and have faces which are disposed at an angle between 5 and 30 degrees less than vertical.

33 Claims, 4 Drawing Sheets

DUELING TREE

RELATED APPLICATIONS

The present application claims the benefit of U.S. Provisional Patent Application No. 60/362,744, filed Mar. 8, 2002.

BACKGROUND OF THE INVENTION

1. Field of the Invention

The present invention relates to a target used in shooting sports. In particular, the present invention relates to a target system, commonly referred to as a dueling tree, in which a plurality of targets are available to a pair of shooters wherein the targets move when they are hit by the shooters.

2. State of the Art

The use of targets to enhance one's shooting ability is extremely common place. For hundreds of years, soldiers, police officers, and the like have used targets to improve their ability to shoot accurately in war time and other high pressure situations. A variety of different mechanisms have been used to simulate these situations in which the shooter's blood pressure will rise and affect his or her shooting ability.

One common method for generating adrenaline and blood pressure increases in a shooter is to have a competition. The competition may be as simple as shooting at a plurality of clay pigeons or other targets. While isolated shooting at targets in competition situations provides a moderate increase in adrenaline flow, a much more significant increase is caused by head-to-head competition wherein both shooters are shooting a target at the same time. This is even more so if the competition is structured such that both shooters know how well the other shooter is doing.

One system for significantly increasing pressure on the shooter during the competition is the use of a system called a dueling tree. Typically, a dueling tree includes a plurality of targets which are mounted on a central support. The targets are mounted such that if a target is hit by one shooter, the target moves into the firing line of the other shooter. Thus, a shooter attempts to strike the targets and move them into his competitors line of fire as quickly as possible. The first person to have all the targets disposed in their line of fire loses the competition.

While a shooter may concentrate on hitting a particular target to move into his opponents line of fire, that concentration is readily broken when a target from the opponent moves over to his or her line of fire. This scenario quickly develops adrenaline and blood pressure increases and causes the shooter to react similarly to a real live situation in which the shooter's life may be in danger.

One problem with some dueling trees is that a target may not completely move to the other side if hit. Other dueling trees are constructed so that even a grazing of the target will cause it to move. While attempts have been made to correct these problems, considerable improvements could be made.

SUMMARY OF THE INVENTION

In accordance with one aspect of the present invention, the dueling tree includes a plurality of targets which are pivotably mounted to the center support so that when they are struck by a bullet, the target rotates 180 degrees and is disposed on the opposite side of the center support. The dueling tree is configured so that the target will generally not get stuck between either side.

In accordance with another aspect of the present invention, the center support is disposed at an angle. This angle, preferably between 5 and 30 degrees short of vertical, and most preferably about 15 degrees, promotes the target to move forward towards the shooter and prevents the target from rotating to the other side of the central support unless it is solidly hit with a round.

In accordance with another aspect of the present invention, the targets are also disposed at an angle short of vertical. The forward angle causes the target to channel bullets downwardly when impacted, thereby minimizing the risk of back splatter.

In accordance with still yet another aspect of the present invention, the center support has a splatter guard attached thereto. The splatter guard limits the movement of bullet fragments traveling toward the center support so as to avoid the fragments from ricocheting and hitting shooters or other individuals in the area.

In accordance with another aspect of the present invention, the target is configured so that the target has a pin integrally formed therein which forms part of a hinge which enables the target to move between a first position and a second position. Because the pin is formed integrally with the target, it is less susceptible to breaking due to the vibrations of the target caused by the target being hit by bullets. This is in contrast to conventional structures wherein the hinge is welded or otherwise attached to the target. Such configurations often break under the repeated fatigue of the target being hit by a bullet. Furthermore, forming the pin and target from a single piece of material decreases expense, as less handling of the target is required.

In a preferred embodiment of the invention, the target is configured to move between a first position and a second position in such a manner than the target is biased into the first position or the second position, and away from a position therebetween, by gravity. Preferably, this is accomplished by the movement having a vertical component. Thus, the target must move upwardly and then back down as it moves from the first position to the second position and vice versa. This inhibits the target from stopping between the first position and the second position, and thereby encourages the target to be disposed in the line of fire of one of the shooters.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims. Furthermore, it should be understood that all embodiments of the invention may not achieve all of aspects of the invention and the claims should not be limited by the preferred embodiments.

Figure 1:
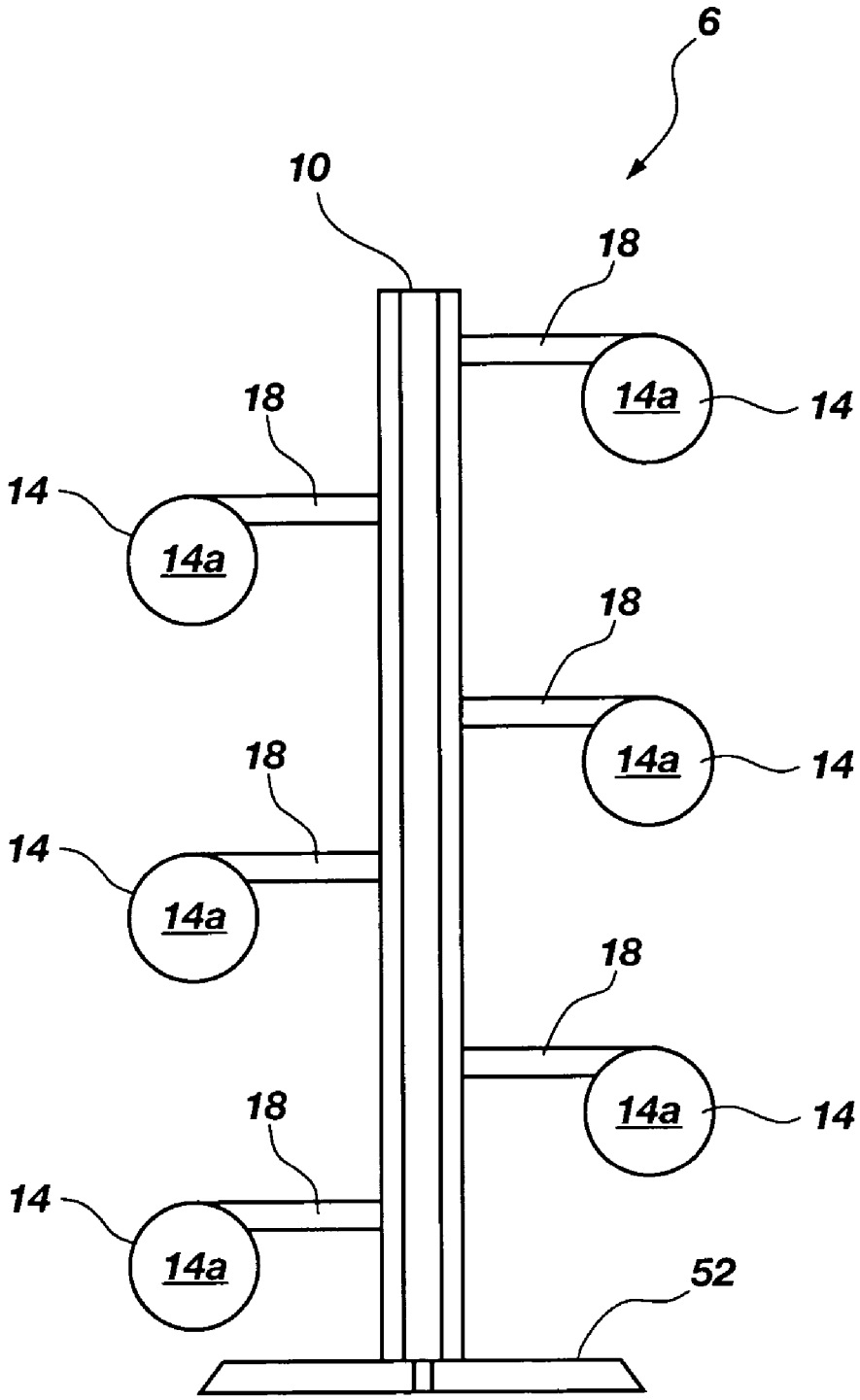
FIG. 1 shows a front view of a dueling tree formed in accordance with the principles of the present invention.

Referring now to FIG. 1, there is shown a front view of a dueling tree, generally indicated at 6, formed in accordance with the principles of the present invention. The dueling tree 6 includes a center support 10, and a plurality of targets 14, which are pivotably mounted to the center support. Each of the targets 14 is mounted such that when the target is hit solidly with a round, the target will rotate approximately 180 degrees and be disposed on the opposing side of the center support 10. As will be explained in additional detail, this can be accomplished by providing a target which has an arm 18 with a portion of the arm forming a pin (not shown). The pin mounts on the center support 10 so as to enable the target to rotate about the pin.

During a shooting competition, a plurality of targets 14 are disposed on each side of the center support 10. For example, in FIG. 1, three plates are disposed on each side of the center support. When a shooter's bullet forcefully impacts a target 14, the target rotates to the opposing side of the center support 10. The first person to have all of the targets 14 disposed on their side of the center support 10, loses the competition.

Figure 2:
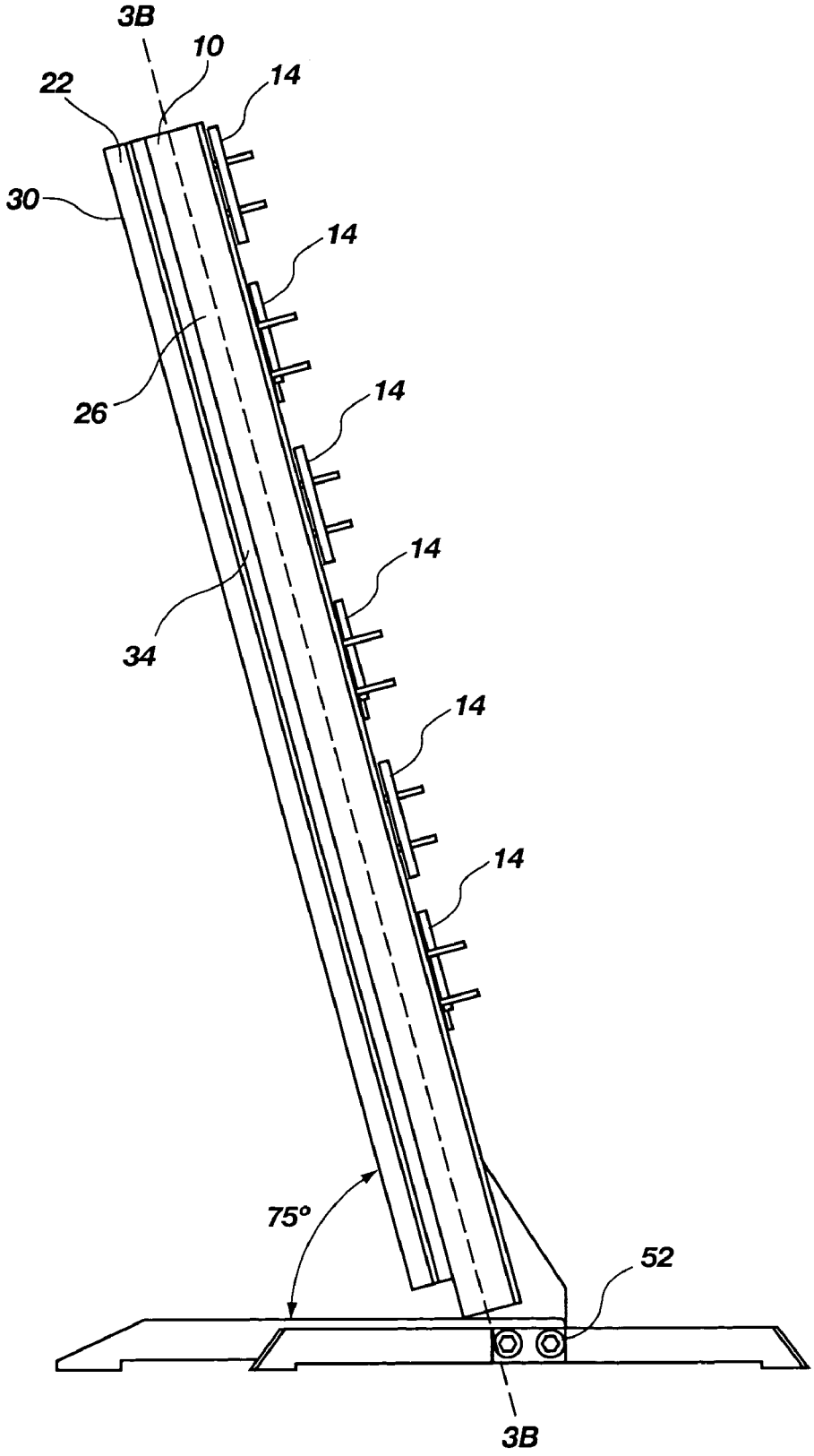
FIG. 2 shows a side view of a dueling tree formed in accordance with the principles of the present invention.

Turning now to FIG. 2, there is shown a side view of the dueling tree 6. The plurality of targets 14 are disposed along the center support 10 so that they are visible only along their ends.

While the center support 10 can be made in variety of configurations, in a preferred embodiment, the center support 10 has a splatter guard 22, which is attached to a deflector plate 26 of the central support 10. The splatter guard 22 receives bullets that splatter laterally toward the center support 10 when impacting the targets 14. Thus, the splatter guard 22 limits the ability of bullet fragments to cross over the central support and injure shooters and by-standers alike. In a preferred embodiment, the splatter guard 22 is formed by a generally V-shaped rail plate 30 which is spaced apart from the deflector plate 26 between 1 to 3 inches. A mid-center rail 34 attaches the plate 30 to the deflector plate 26.

Figure 3:
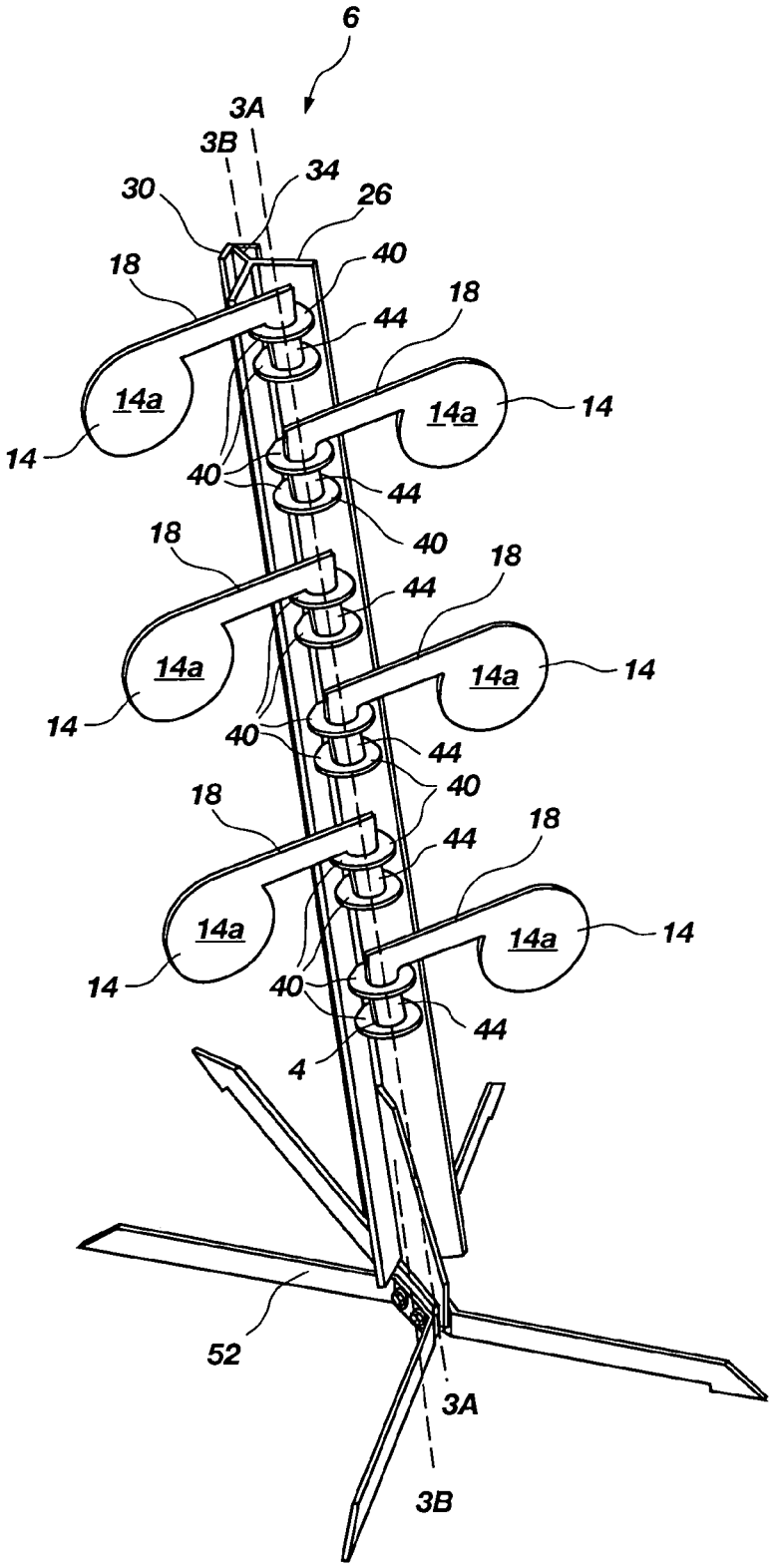
FIG. 3 shows a perspective view of a dueling tree formed in accordance with the principles of the present invention.

Turning now to FIG. 3, there is shown a perspective view of the dueling tree 6. A plurality of rings 40 are attached to the deflector plate 26. The rings are configured to receive a pin 44 formed by a portion of the arm 18 of the target 14. (As shown in FIG. 3, the "pin" need not be cylindrical, and is typically flat. Rather, "pin" is used because the target rotates about an axis 3A—3A extending through the structure).

As a target 14 is struck by a bullet, the target rotates about the pin 44 in rings 40 to the opposing side of the central support 10. It is preferred that the target and the rings 40 are formed from steel to increase longevity of the dueling tree.

As shown in the above-referenced drawings, the dueling tree is preferably disposed in an orientation other than vertical. While the base 52 is disposed horizontally, the longitudinal axis 3B—3B of the central support 10 is disposed at an angle. The angle should be between about 10 and 30 degrees and preferably approximately 15 degrees from vertical (75 degrees from horizontal). This angle provides several advantages. First, the angle encourages the targets 14 to fall into forwardly into a position in which they extend outwardly from the central portion generally perpendicular to the line of fire. If the dueling tree 6 is disposed vertically, the targets have a tendency to bounce backward away from the line of fire and to be disposed where they are not fully presented to the shooter. In the configuration shown in FIG. 3, however, the targets 14 travel along a path in which they move vertically upward as they move horizontally between the first position and a second position disposed on an opposite side of the center support. Thus, the targets are drawn by gravity into either the first position or the second position and away from the area in-between.

Providing the face 14*a* of the target 14 at the same angle, also helps to channel bullet fragments downwardly once they impact the target. This minimizes lateral scattering of the bullet fragments and decreases the risk that a ricochet may injure a shooter or by-stander.

Figure 4:
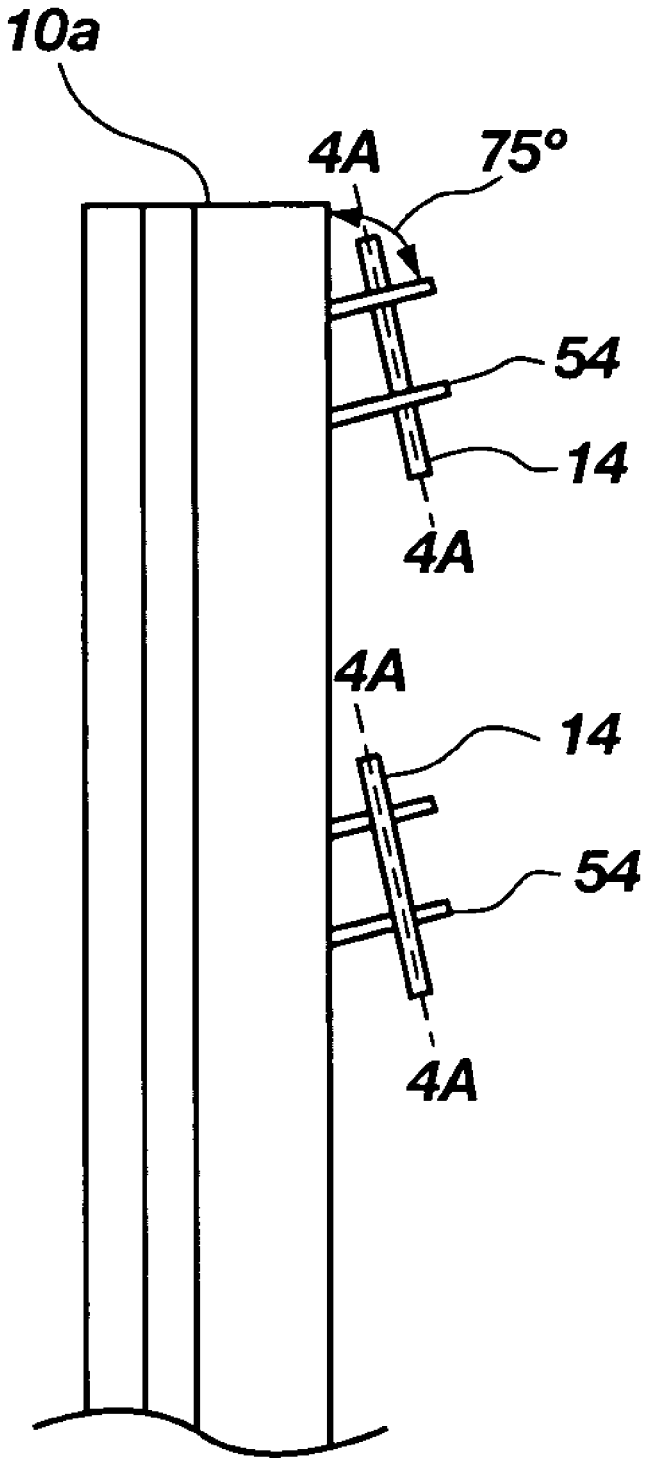
FIG. 4 shows an alternate embodiment of a dueling tree formed in accordance with the principles of the present invention.

Turning now to FIG. 4, there is shown an alternate embodiment of the invention. Rather than having the longitudinal axis of the central support 10*a* at an angle, the central support extends substantially vertically. The rings 54 which hold the targets 14, however, are not disposed perpendicular to the central support 10*a* as in the previous embodiment. Rather, the rings 54 are positioned to extend about between about 10 and 30 degrees above horizontal, or 60 to 80 degrees less than vertical. Preferably, the rings 45 are positioned at about 15 degrees above horizontal. This causes the pins of the targets to rotate about an axis 4A—4A which is 15 degrees less than of vertical (i.e. 75 degrees above horizontal). As with the prior embodiment, the angle tends to cause the targets to rotate forwardly into a position perpendicular to the line of fire. This also results in the face of the targets 14 being angled downwardly about 15 degrees, thereby deflecting bullets downwardly.

Thus there is disclosed an improved dueling tree. While the embodiment shown in FIGS. 1 through 4 are currently preferred embodiments, those skilled in the art will appreciate that numerous modifications can still be made within the principles of the present invention. The appended claims are intended to cover such modifications.

What is claimed is:

1. A bullet target system comprising:

a center support extending generally upwardly; and a plurality of bullet resistant targets pivotably mounted to the center support so as to form a hinge so as to enable the targets to pivot between opposing sides of the support, the hinge axis being less than vertical so as to bias the targets into a position on either side of the center support.

2. The bullet target system according to claim 1, wherein the hinge axis is disposed at an angle of between 10 and 30 degrees less then vertical.

3. The bullet target system according to claim 2, wherein the hinge axis is disposed at an angle of about 15 degrees from vertical.

4. The bullet target system according to claim 1, wherein the center support comprises a deflector plate.

5. The bullet target system according to claim 4, further comprising a splatter guard attached to the deflector plate.

6. The bullet target system according to claim 1, wherein the targets each have a face, and wherein at least a plurality of targets have a face which is disposed between 10 and 30 degrees less than vertical.

7. The bullet target system according to claim 6, wherein the target faces are disposed at an angle of about 15 degrees less than vertical.

8. The bullet target system according to claim 1, wherein the center support has a longitudinal axis disposed at an angle of between 10 and 30 degrees less than vertical.

9. The bullet target system according to claim 8, wherein the longitudinal axis of the center support is disposed at an angle of about 15 degrees from vertical.

10. The bullet target system according to claim 1, further comprising a plurality of rings for receiving arms of the targets and for allowing a portion of the arms to rotate within said rings.

11. A bullet target system comprising:

a center support extending generally upwardly;

a plurality of targets pivotably mounted to the center support so as to enable the targets to pivot between opposing sides of the support, the targets being pivotable about an axis which is less than vertical so as to bias the targets into a position on either side of the center support;

a plurality of rings for receiving arms of the targets and for allowing a portion of the arms to rotate within said rings; and, wherein the center support has a longitudinal axis and wherein the plurality of rings extend perpendicular to the longitudinal axis.

12. A bullet target system comprising:

a center support extending generally upwardly;

a plurality of targets pivotably mounted to the center support so as to enable the targets to pivot between opposing sides of the support, the targets being pivotable about an axis which is less than vertical so as to bias the targets into a position on either side of the center support;

a plurality of rings for receiving arms of the targets and for allowing a portion of the arms to rotate within said rings; and, wherein the center support has a longitudinal axis and wherein the plurality of rings extend at an angle between 10 and 30 degrees less than perpendicular from the longitudinal axis.

13. The bullet target system according to claim 12, wherein the longitudinal axis of the center support and the rings are disposed at an angle of between about 10 and 30 degrees less than perpendicular.

14. A bullet target system comprising:

a center support having a plurality of attachment points for pivotably holding targets; and a plurality of steel plate bullet targets rotatably attached to the attachment points so as to form a hinge, the hinge having an axis disposed at an angle less than vertical, such that impacting a target with a bullet causes the target to rotate to an opposing side of the center support, and wherein at least one of the targets having a face which is disposed at an angle of between 5 and 30 degrees less than vertical.

15. The bullet target system according to claim 14, wherein the center support has a long axis which is disposed at an angle of between 10 and 30 degrees less than vertical.

16. The bullet target system according to claim 15, wherein the attachment points comprise a plurality of rings.

17. The bullet target system according to claim 14, wherein the faces of the targets are disposed about 15 degrees less than vertical.

18. The bullet target system according to claim 17, wherein the center support has a long axis and wherein the faces of the targets are disposed substantially parallel to the long axis of the center support.

19. A method for forming a bullet target system, the method comprising:

selecting a center support and positioning the support to extend generally upwardly;

disposing a plurality of targets in rotatable engagement with the center support so that each of the targets can rotate between positions on opposing sides of the center support by rotating behind the center support; and causing the targets to rotate about an axis which is between about 10 and 30 degrees less than vertical so as to bias the targets away from a position behind the center support and into a position on either side of the center support.

20. The method of forming a bullet target system according to claim 19, wherein the targets have faces and wherein the faces are disposed between 10 and 30 degrees less than vertical.

21. A target system for bullet target practice, the target comprising:

a bullet proof target which is mounted to a support and which is movable between a first position and a second position by passing behind the support; and a pin which is attached to the support so as to form a hinge and which rotates as the target moves between the first position and the second position, the pin being formed integrally with the target and being disposed such that the hinge forms an angle of about 10–30 degrees less than vertical relative to a shooter so as to bias the target into the first or second positions.

22. The target system according to claim 21, further comprising an arm formed integrally with the pin and the target for spacing the target from the pin.

23. The target system according to claim 21, wherein the support further comprises at least one mounting bracket having a hole formed therethrough, the pin interacting with the mounting bracket to form a hinge.

24. The target system according to claim 23, wherein the first position and the second position are in substantially the same horizontal plane and wherein the target moves vertically as it moves between the first position and the second position.

25. The target system according to claim 21, wherein the pin has an axis of rotation extending therethrough and wherein the axis of rotation is between 10 and 30 degrees less then vertical.

26. A target system comprising:

at least one target, the target comprising a bullet target and a pivot, and being alternatively pivotable between a first position and a second position and through an area between the first position and second position when struck by a bullet, and wherein the pivot rotates about an axis without translating along the axis, the axis being disposed at an angle less than vertical such that the target is configured to be biased by gravity into the first position or second position and away from the area between the first position and the second position, and wherein the bullet target resists the penetration of bullets therethrough sufficiently to move then target between the first position and second position when properly struck by a bullet.

27. The target system according to claim 26, wherein the bullet target travels upwardly as it passes through the area between the first position and the second position.

28. The target system according to claim 26, wherein the target is disposed at an angle of about 10 to 30 degrees less then vertical.

29. The target system according to claim 26, further comprising a pin about which the target pivots between the first position and the second position.

30. The target system according to claim 29, wherein the pin is disposed at an angle of between about 10 and 30 degrees less than vertical.

31. The target system according to claim 29, wherein the pin is formed integrally with the target.

32. The target system according to claim 26, further comprising a stationary center support for holding the target.

33. The target system according to claim 32, wherein the center support has rings attached thereto for receiving the target.

* * * * *

UNITED STATES PATENT AND TRADEMARK OFFICE

CERTIFICATE OF CORRECTION

PATENT NO. : 6,994,348 B2
APPLICATION NO. : 10/383218
DATED : February 7, 2006
INVENTOR(S) : Spencer Lambert et al.

It is certified that error appears in the above-identified patent and that said Letters Patent is hereby corrected as shown below:

Column 6
Line 43 Claim 26 reads "bullets therethrough sufficiently to move then target" should read -- bullets therethrough sufficiently to move the target --

Signed and Sealed this

First Day of January, 2008

JON W. DUDAS
*Director of the United States Patent and Trademark Office*